US010913624B2

(12) United States Patent
Chatry et al.

(10) Patent No.: US 10,913,624 B2
(45) Date of Patent: Feb. 9, 2021

(54) DEVICE FOR GRASPING INSERT SHEETS, LOADING DEVICE, STATION FOR RECEIVING BLANKS AND MACHINE FOR PROCESSING ELEMENTS IN THE FORM OF SHEETS

(71) Applicant: BOBST MEX SA, Mex (CH)

(72) Inventors: Patrice Chatry, Lugrin (FR); Ludovic Cuennet, Monthey (CH); Maude Steiner, Morrens (CH)

(73) Assignee: BOBST MEX SA

( * ) Notice: Subject to any disclaimer, the term of this patent is extended or adjusted under 35 U.S.C. 154(b) by 30 days.

(21) Appl. No.: 16/076,357

(22) PCT Filed: Feb. 7, 2017

(86) PCT No.: PCT/EP2017/025021

§ 371 (c)(1),
(2) Date: Aug. 8, 2018

(87) PCT Pub. No.: WO2017/137169

PCT Pub. Date: Aug. 17, 2017

(65) Prior Publication Data

US 2019/0047807 A1 Feb. 14, 2019

(30) Foreign Application Priority Data

Feb. 12, 2016 (EP) ..... 16020041

(51) Int. Cl.
*B65H 3/08* (2006.01)
*B65H 31/32* (2006.01)
*B65H 33/04* (2006.01)

(52) U.S. Cl.
CPC ..... *B65H 3/0833* (2013.01); *B65H 3/0883* (2013.01); *B65H 31/32* (2013.01);
(Continued)

(58) Field of Classification Search
CPC ... B65H 1/04; B65H 3/06; B65H 3/52; B65H 3/5223; B65H 3/5238; B65H 3/54;
(Continued)

(56) References Cited

U.S. PATENT DOCUMENTS 4,171,081 A 10/1979 Vossen et al. ..... 225/97
4,509,736 A 4/1985 Stahl et al. ..... 271/106
4,566,846 A * 1/1986 Cartwright ..... B65H 3/0883 271/107

FOREIGN PATENT DOCUMENTS

DE 195 16 023 A1 11/1996

OTHER PUBLICATIONS

International Search Report dated May 8, 2017 in corresponding PCT International Application No. PCT/EP2017/025021.
(Continued)

*Primary Examiner* — Thomas A Morrison
(74) *Attorney, Agent, or Firm* — Ostrolenk Faber LLP

(57) ABSTRACT

The invention relates to an insert-sheet pick-up device (13) for an insert-sheet loading device (10) of a station for receiving copy (500). The pick-up device (13) includes a suction element (20) configured to pick up an insert sheet. The pick-up device (13) includes a pivoting axis (30) and at least one telescopic arm (33) including a proximal arm (33*a*), one end of which is fixed to the pivoting axis (30), and a distal arm (33*b*), able to move with respect to the proximal arm (33*a*), and one end of which is pivot-articulated to the suction element (20) to move the suction element (20) between a raised position and a lowered position according to a vertical movement of the suction element (20). Also, the invention also relates to an insert-sheet loading device, a copy-receiving station and a machine for processing elements in sheet form including the insert-sheet pick-up device.

17 Claims, 4 Drawing Sheets

(52) U.S. Cl.
CPC ..... *B65H 33/04* (2013.01); *B65H 2301/4263* (2013.01); *B65H 2402/343* (2013.01); *B65H 2405/323* (2013.01); *B65H 2406/341* (2013.01); *B65H 2406/342* (2013.01); *B65H 2701/1764* (2013.01); *B65H 2701/18264* (2013.01); *B65H 2801/42* (2013.01)

(58) Field of Classification Search
CPC .... B65H 3/047; B65H 3/0669; B65H 3/0676; B65H 3/523; B65H 3/0833; B65H 5/023; B65H 5/025; B65H 5/066; B65H 5/068; B65H 5/26
See application file for complete search history.

(56) References Cited

OTHER PUBLICATIONS

Written Opinion dated May 8, 2017 in corresponding PCT International Application No. PCT/EP2017/025021.

* cited by examiner

DEVICE FOR GRASPING INSERT SHEETS, LOADING DEVICE, STATION FOR RECEIVING BLANKS AND MACHINE FOR PROCESSING ELEMENTS IN THE FORM OF SHEETS

CROSS-REFERENCE TO RELATED APPLICATIONS

The present application is a 35 U.S.C. §§ 371 national phase conversion of PCT/EP2017/025021, filed Feb. 7, 2017 which claims priority of European Patent Application No. 16020041.6, filed Feb. 12, 2016, the contents of which are incorporated by reference herein. The PCT International Application was published in the French language.

The present invention relates to a device for grasping insert sheets for insertion between stacks of blanks in a receiving region of a station for receiving blanks. The present invention also relates to a device for loading insert sheets, a station for receiving blanks and a machine for processing elements in the form of sheets comprising said device for grasping insert sheets.

In a receiving station, separation of blanks consists, after finishing and complete ejection of the waste, in breaking the points of attachment between the blanks of a sheet by means of a male upper tool and a female lower tool mounted vertically above one another in the region for receiving sheets. The upper tool is formed by pusher elements which are slightly smaller than the periphery of the blanks. The lower tool is formed by a grid in which the shape of the openings generally corresponds to the periphery of the blanks. The blanks drop through these openings and are piled up in vertical stacks in the receiving region.

In order to form separated and stable stacks of blanks below these tools and on the receiving pallet of the station, periodic insertion of a stabilizing sheet proves necessary. The insertion consists in arranging an insert sheet, such as a full sheet, between stacks of blanks. In order that this insertion can be performed without requiring a concomitant stopping of the production unit, use is made of a device commonly referred to as a non-stop receiving grid.

To perform an insertion operation, an insert sheet is grasped from a stack of insert sheets arranged in the vicinity of the receiving region. The insert sheet is then released onto the non-stop blank receiving grid. The non-stop receiving grid carrying the insert sheet is then moved under the lower tool for separating the blanks. The non-stop receiving grid then returns above the stack of insert sheets to receive a new sheet. When leaving the receiving region, the grid crosses the teeth of a comb which has pivoted into the retaining position to retain the insert sheet and thus the blanks stacked on this insert sheet in the receiving region. The non-stop receiving grid thus makes it possible to deposit an insert sheet between the stacks of blanks and to support the blanks during the removal of the stacks of blanks without stopping the production.

The grasping of the insert sheet then and depositing it on the non-stop receiving grid is generally achieved by means of a device having suction cups. A known example of such a device comprises a bar of suction cups which can pivot between a lower position, at which the suction cups grasp the edge of an insert sheet and an upper position to raise the sheet and then release it onto the non-stop receiving grid. This device has the advantage of being compact; in particular, the bulk of the bar of suction cups in the upper position is compatible with the residual space situated below the removal belt of the removal station, itself situated above the system for loading the insert sheets.

However, the region for grasping the insert sheets is offset from the edge of the sheet with the lowering of the height of the stack of sheets on account of the mowing movement of the bar of suction cups. The more the height of the stack of insert sheets decreases and the more the grasping region moves away from the edge of the sheet, this offset increases with the increase in the depth of the reserve trays. The positioning of the insert sheet can then become imprecise. The insert sheet can be offset on the non-stop receiving grid, then offset between the blanks of the stack. The correct positioning of the insert sheet between the stacks of blanks is then no longer guaranteed.

SUMMARY OF THE INVENTION

One object of the present invention is to propose an improved device for grasping insert sheets that makes it possible to grasp the insert sheet in one grasping region, with a reduced bulk, whatever the height of the stack of insert sheets.

Accordingly, one subject of the present invention is a device for grasping insert sheets for a device for loading insert sheets of a station for receiving blanks. The grasping device comprises a suction element configured to grasp an insert sheet. The grasping device comprises a pivoting axle and at least one telescopic arm comprising a proximal arm, of which one end is fixed to the pivoting axle, and a distal arm, which is movable with respect to the proximal arm, and of which one end is pivotably articulated with the suction element in order to move the telescopic arm and the suction element between an upper position and a lower position with a vertical movement of the suction element.

The combination of the pivoting movement of the telescopic arms and their lengthening/shortening makes it possible to perform a vertical movement of the telescopic arm and the suction element between the upper and lower positions. The grasping region can thus always be provided at the same location of the insert sheet, thereby ensuring that the insert sheet is correctly positioned for insertion operation. This device for grasping insert sheets therefore takes up little space while making it possible for the suction element to be lowered sufficiently low into the housing of the tray to grasp an insert sheet at the bottom of the tray. Such a reduced bulk arrangement is simpler and more economical to realize than would be to provide, for example, a tray which is vertically movable as a function of the height of the contained stack.

According to one or more features of the grasping device, taken alone or in combination:

- the telescopic arm lengthens when it pivots into the lower position,
- in the upper position, the telescopic arm is in a position close to the horizontal,
- the grasping device comprises at least one element for controlling the lengthening of the distal arm as a function of the pivoting angle of the pivoting axle, configured to cooperate with the distal arm of the telescopic arm,
- the control element comprises a linear or curved guide,
- the control element comprises an inclined slot,
- the positioning of the distal arm in a first position of the slot corresponding to a minimum lengthening of the telescopic arm in the upper position,
- the positioning of the distal arm in a second position of the slot corresponding to a maximum lengthening of the telescopic arm in the lower position, the telescopic arm having pivoted by a predetermined maximum angle between the first and the second position, the hypotenuse of a right triangle of which one of the legs corresponds to the lengthening of the telescopic arm over the predetermined maximum angle being inscribed within the slot, one of the distal arm and the proximal arm comprises at least one oblong linear guide hole cooperating with at least one pin borne by the other arm in order to modify the length of the telescopic arm, the proximal arm comprises a double wall sandwiching the distal arm, the suction element comprises at least one pivoting suction head, the suction element comprises a suction bar, the grasping device comprises two telescopic arms of which respective ends are pivotally articulated with a respective end of the suction bar, the grasping device comprises at least one actuator configured to pivot the pivoting axle, the actuator is configured to stop automatically under the effect of a counterforce, the actuator is configured to move a first end of a lever of which a second end is fixed to the pivoting axle.

Another subject of the invention is a device for loading insert sheets, comprising a device for grasping insert sheets as defined above.

Another subject of the invention is a station for receiving blanks of a machine for processing elements in the form of sheets, comprising a device for loading insert sheets as defined above.

Yet another subject of the invention is a machine for processing elements in the form of sheets, comprising a station for receiving blanks as defined above.

BRIEF DESCRIPTION OF THE DRAWINGS

Further advantages and features will become apparent from reading the description of the invention and from the appended Figures, which show a nonlimiting exemplary embodiment of the invention and in which.

DESCRIPTION OF EMBODIMENTS

In these Figures, identical elements bear the same reference numbers. The following embodiments are examples. Although the description refers to one or more embodiments, this does not necessarily mean that each reference concerns the same embodiment, or that the features apply only to a single embodiment. Simple features of various embodiments can also be combined or interchanged to provide other embodiments.

Figure 1:
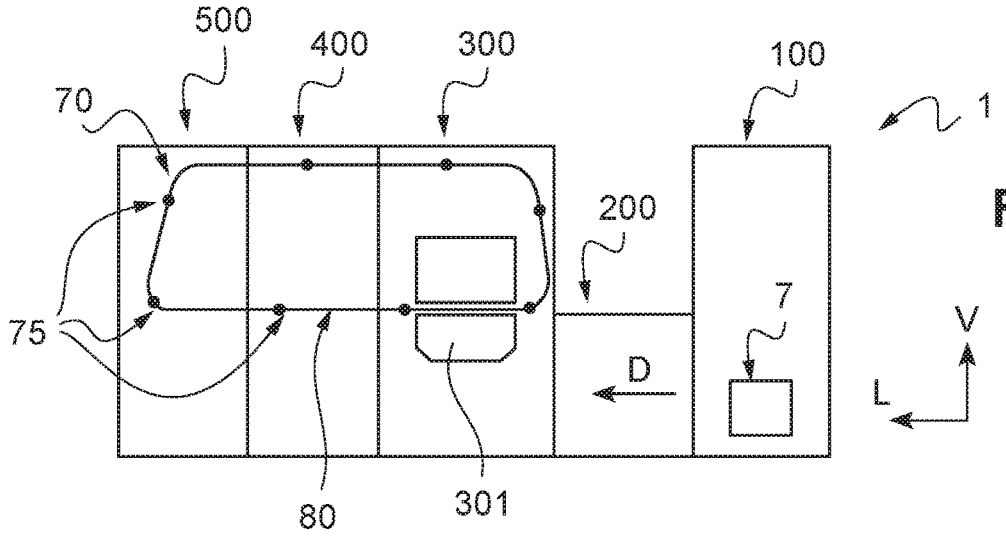
FIG. 1 illustrates highly schematically an example of a machine for processing elements in the form of sheets.
Figure 2:
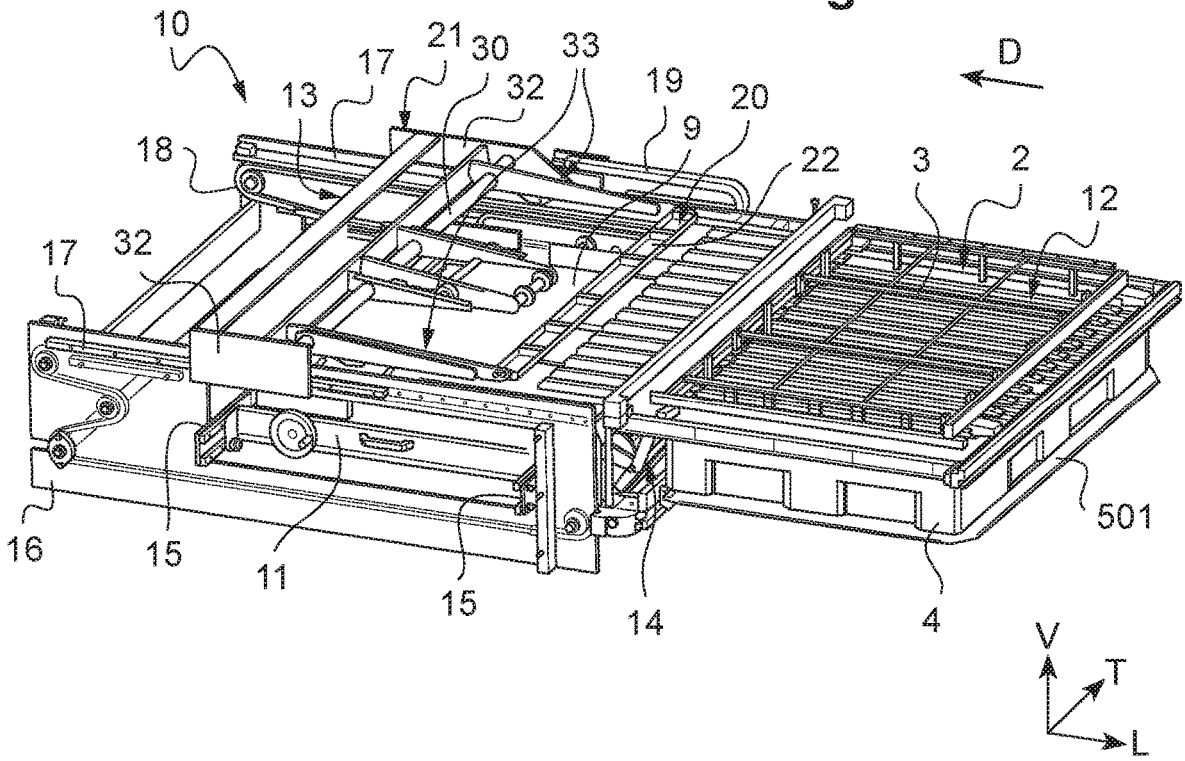
FIG. 2 shows a first exemplary embodiment of a device for loading insert sheets, arranged beside a region for receiving blanks, with a non-stop receiving grid situated in the receiving region and a device for grasping insert sheets in the upper position.

The longitudinal, vertical and transverse directions indicated in FIG. 2 are designated by the trihedron (L, V, T). The transverse direction T is the direction perpendicular to the longitudinal direction of movement D of a sheet, as illustrated by the arrow D in FIGS. 1 and 2. The horizontal plane corresponds to the plane (L, T).

The terms upstream and downstream are defined with reference to the longitudinal direction of movement D. The sheets move from upstream to downstream, generally following the longitudinal main axis of the machine, in a movement timed by periodic stops.

The terms "flat elements" and "sheets" will be considered as equivalent and will equally concern elements comprised of corrugated cardboard and flat cardboard, paper or any other material commonly used in the packaging industry. It will be understood that throughout this text, the terms "sheet" or "sheet element" or "element in the form of sheets" designates very generally any printable medium in the form of sheets, such as sheets of cardboard, of paper, of plastic, etc.

FIG. 1 represents an example of a processing machine 1 for the transformation of sheets. This processing machine 1 is conventionally comprised of a plurality of workstations which are juxtaposed but interdependent on one another to form a unitary assembly. There is an introduction station 100, a feed table 200, a transformation station 300 for cutting the sheets, for example comprising a platen press 301, a station 400 for ejecting waste, and a station 500 for receiving blanks, where the transformed sheets are restacked and the cut sheet waste is removed.

The operation of transforming each sheet takes place in the transformation station 300, for example between a fixed platen and a lower movable platen of the press 301 for cutting the sheets in accordance with a matrix corresponding to the developed shape that is desired to be obtained, for example with a view to obtaining a plurality of boxes of a given shape. The movable platen rises and falls successively once during each machine cycle.

A transport device 70 is provided to individually move each sheet from the outlet of the feed table 200 to the station 500 for receiving blanks while passing through the press-transformation station 300.

The transport device 70 comprises a plurality of transverse bars provided with grippers, commonly referred to as gripper bars 75, which each in turn grasp a sheet at its front edge before pulling the sheet successively through the different workstations 300, 400, 500 of the machine 1.

The ends of the gripper bars 75 are each respectively connected to a lateral chain forming a loop, commonly referred to as a chain system 80. Two chain systems 80 are thus arranged laterally on either side of the gripper bars 75.

By virtue of a movement transmitted to the chain systems 80, all the gripper bars 75 will start from a stopped position, accelerate, reach a maximum speed, decelerate and then stop, thus describing a cycle corresponding to the movement of a sheet from one workstation to the following workstation. The chain systems 80 move and stop periodically such that, during each movement, all the gripper bars 75 in engagement with a sheet are passed from one station to the adjacent downstream workstation. Each station performs its work in synchronization with this cycle, which is commonly referred to as the machine cycle. The workstations are in the initial position to start new work upon each start of the machine cycle.

The number and the nature of the processing stations in a processing machine 1 can vary as a function of the nature and the complexity of the operations to be performed on the sheets. Within the context of the invention, the notion of a processing machine thus covers a very large number of embodiments, owing to the modular structure of these assemblies. Depending on the number, the nature and the arrangement of the workstations used, it is in fact possible to obtain a multitude of different processing machines. It is also important to stress that there are other types of workstations than those mentioned, such as stations for embossing, scoring or such as stations for loading strips to be stamped for a stamping machine or hot foil stamping machine, where patterns obtained from a foil originating from one or more strips to be stamped are applied to each sheet between the platens of a press. Finally, it will be understood that the same processing machine can be equipped with a plurality of stations of the same type.

In the station 500 for receiving blanks, after they are finished in the transformation station 300, and ejecting the waste in the station 400 for ejecting the waste, then the points of attachment between the blanks of a sheet are broken by means of a male upper tool and a female lower tool mounted vertically above one another in a receiving region 2 represented in FIG. 2.

The upper tool is formed by pusher elements which are slightly smaller than the periphery of the blanks. The lower tool 3 is formed by a grid in which the shape of the openings generally corresponds to the periphery of the blanks. In the example, the lower tool 3 comprises longitudinal and transverse bars forming a grid with square or other shape openings. The blanks fall through the openings of this grid and are piled in vertical stacks in the receiving region 2 on a receiving pallet 4 borne by a vertically movable frame 501 of the station 500.

The station 500 for receiving blanks comprises a device 10 for loading insert sheets that is fixed to the frame of the machine 1. The insertion consists in arranging an insert sheet, such as a full sheet, between stacks of blanks in the receiving region 2.

The loading device 10 comprises a reserve tray 11 for insert sheets, a non-stop receiving grid 12, a device 13 for grasping insert sheets and a pivoting retaining comb 14.

The tray 11 comprises a housing 9 intended to receive a stack 8 of insert sheets. The tray 11 is movable translationally in the transverse direction T in order to be able to be reloaded by an operator through an aperture in the frame 16 of the loading device 10 from one side of the loading device 10. The tray 11 can be mounted on two transverse slide rails 15 and comprises a handle, like a drawer.

The non-stop receiving grid 12 is movable translationally in the longitudinal direction of movement D of the sheets between a retracted position above the tray 11 for receiving an insert sheet (FIG. 3) and an extended position for the insertion of the insert sheet in the receiving region 2 (FIG. 2).

The non-stop receiving grid 12 comprises at least one crossmember bearing a plurality of longitudinal bars. The ends of the crossmember are, for example, provided with rotating rollers cooperating with longitudinal slide rails 17 borne by the frame 16. The receiving grid 12 is driven translationally by two chains 18 driven by a motor (not visible) controlled by a control unit 7 of the processing machine 1 in order to program an insertion when the stack of blanks reaches the desired height.

The retaining comb 14 comprises teeth which are regularly spaced in the transverse direction. The comb 14 is pivotably mounted about a transverse axle interposed between the tray 11 and the region 2 for receiving blanks. The comb 14 pivots between a retaining position in which the teeth of the comb 14 pass between the longitudinal bars of the non-stop receiving grid 12 and a released position in which the teeth of the comb are retracted.

The device 13 for grasping insert sheets is arranged above the non-stop receiving grid 12 when the latter is in the retracted position. The grasping device 13 is configured to lift an insert sheet from the reserve tray 11 for insert sheets and to deposit the lifted insert sheet onto the non-stop receiving grid 12 when the latter moves into the retracted position above the tray 11.

The device 13 for grasping insert sheets comprises a suction element 20 configured to grasp an insert sheet and comprises a support 21 intended to be mounted on the frame 16 of the loading device 10 in order to carry and move the suction element 20 toward or away from the stack 8 of insert sheets. The support 21 can be mounted so as to slide longitudinally on the frame 16 in order to adapt the longitudinal positioning of the grasping region to the format of the insert sheets.

The support 21 comprises a pivoting axle 30 and at least one telescopic arm 33. The telescopic arm 33 comprises a proximal arm 33*a* of which one end is fixed to the pivoting axle 30 and a distal arm 33*b* which is movable with respect to the proximal arm 33*a* in the main direction of the proximal arm 33*a*. One end of the distal arm 33*b* is pivotally articulated with the suction element 20 in order to move the suction element 20 between an upper position (FIG. 6*a*) and a lower position (FIG. 6*b*).

The rotation of the pivoting axle 30 causes the telescopic arms 33 to lengthen or shorten. The combination of the pivoting movement of the telescopic arms 33 and their lengthening/shortening makes it possible to perform a vertical movement of the suction element 20 between the upper and lower positions.

There is provision in particular that the telescopic arm 33 lengthens when it pivots into the lower position. Furthermore, the telescopic arm 33 can be in a position close to the horizontal in the upper position (FIGS. 5 and 6*a*), that is, that the telescopic arm 33 is arranged at the horizontal in the upper position with a possible inclination with respect to the horizontal that is less than +/−5°, thereby limiting the bulk of the grasping device 13 in the upper position. Such an arrangement has a reduced bulk and is simple and economic to realize.

The suction element 20 is connected to a vacuum source, such as a vacuum pump or a Venturi device, for example by means of hoses borne, on the one hand, by a "U"-shaped hose holder 19 of the support 21 and, on the other hand, by a housing 25 of the support 21. The housing 25 is, for example, fixed to the pivoting axle 30. The hoses make it possible to adapt the length of the lines to the upper or lower position of the suction element 20. The hose holder 19 facilitates the guidance of the hoses, in particular when the support 21 slides on the frame 16. The housing 25 makes it possible to accommodate an excess length of the hoses to allow their extension when the grasping device 13 is in the lower position. The housing 25 is, for example, arranged at the center of the pivoting axle 30.

The vacuum source is controlled by the control unit 7 to establish a low suction pressure in the suction element 20 or to stop the suction.

The suction element 20 comprises one or a plurality of suction heads 23, such as suction cups. The suction cups comprise a flexible dome which can be maintained by the pressure of the air on the surface of the insert sheet.

The suction heads 23 can be pivotably mounted about a transverse axis in such a way that gravity and/or the suction force makes it possible to correctly orient the suction heads 23 flat against the insert sheet.

According to one exemplary embodiment, the suction element 20 comprises a suction bar comprising a transverse bar 22 perpendicular to the longitudinal direction of movement D of the sheets. In the example illustrated in FIG. 5, the suction element 20 comprises a suction bar provided with five suction heads 23 arranged symmetrically and mounted pivotably in the transverse bar 22.

As can be seen in FIGS. 2 to 5, the support 21 comprises, for example, two telescopic arms 33 of which the respective ends are pivotably articulated with a respective end of the suction bar, thereby imparting better rigidity to the system and facilitating the alignment of the suction heads 23.

Figure 5:
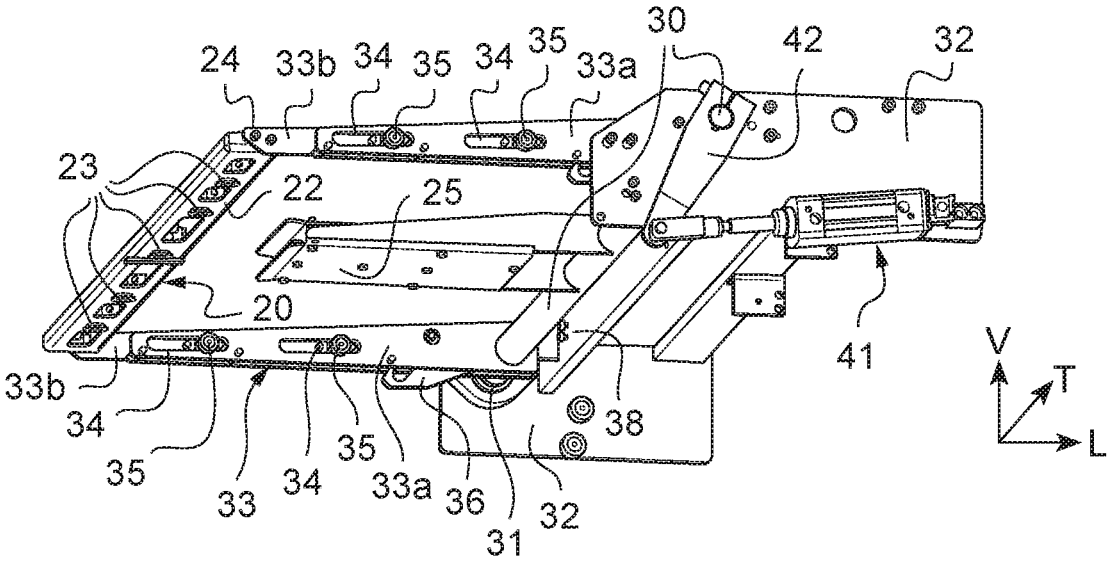
FIG. 5 shows a perspective view of the grasping device of FIG. 2 in the upper position.

The suction element 20 comprises, for example, a cylindrical pin 24 at each end cooperating with a complementary orifice formed in the end of the distal arm 33*b*. The telescopic arms 33, the pivoting axle 30 and the suction bar 20 form a substantially horizontal frame in the upper position (FIG. 5).

One of the distal arm 33*b* and the proximal arm 33*a* comprises at least one oblong linear guide hole 34 extending in the main direction of the proximal arm 33*a*, such as a slot. The oblong hole 34 cooperates with at least one pin 35 borne by the other arm in order to modify the length of the telescopic arm 33, that is, lengthen or shorten the length of the distal arm 33*b* with respect to the proximal arm 33*a*. In the example illustrated, the proximal arm 33*a* comprises, for example, two aligned oblong holes 34 cooperating with a respective pin 35 of the distal arm 33*b*. The length of the oblong holes 34 is, for example, between 30 and 50 mm, such as of the order of 40 mm.

Other embodiments can be envisioned for the at least one telescopic arm 33. For example, the distal arm 33*b* is slidable with respect to the proximal arm 33*a* by means of a rail borne by the proximal arm 33*a* or by the distal arm 33*b*, the other arm bears a complementary rib. According to another example, the distal arm 33*b* is movable by nesting engagement in the proximal arm 33*a*, the distal arm 33*b* and the proximal arm 33*a* having, for example, complementary cylindrical shapes.

The support 21 can additionally comprise at least one element 36 for controlling the lengthening of the distal arm 33*b* as a function of the pivoting angle of the pivoting axle 30, configured to cooperate with the distal arm 33*b* of the telescopic arm 33. The control element 36 comprises, for example, a linear or curved guide.

The control element 36 comprises, for example, a cam roller and a cam, one being borne by the distal arm 33*b*, the other being fixed to the transverse beam 38 (not shown). The cam roller is urged counter to the cam, the cam surface defining the lengthening of the distal arm 33 as a function of the pivoting angle of the pivoting axle 30.

Figure 6A:
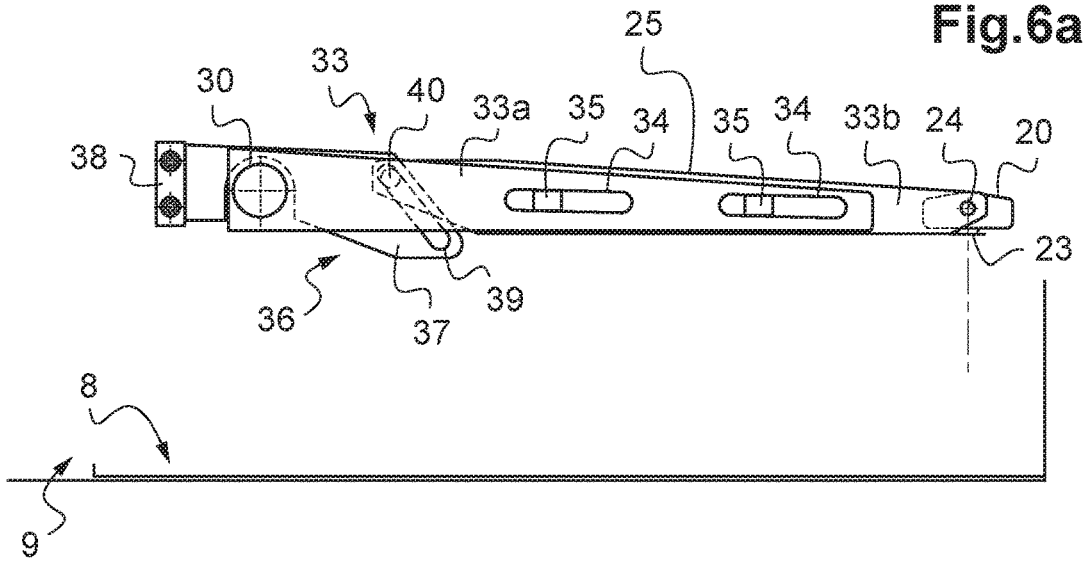
FIG. 6*a* shows a side view of elements of the grasping device of FIG. 2 in the upper position.
Figure 6B:
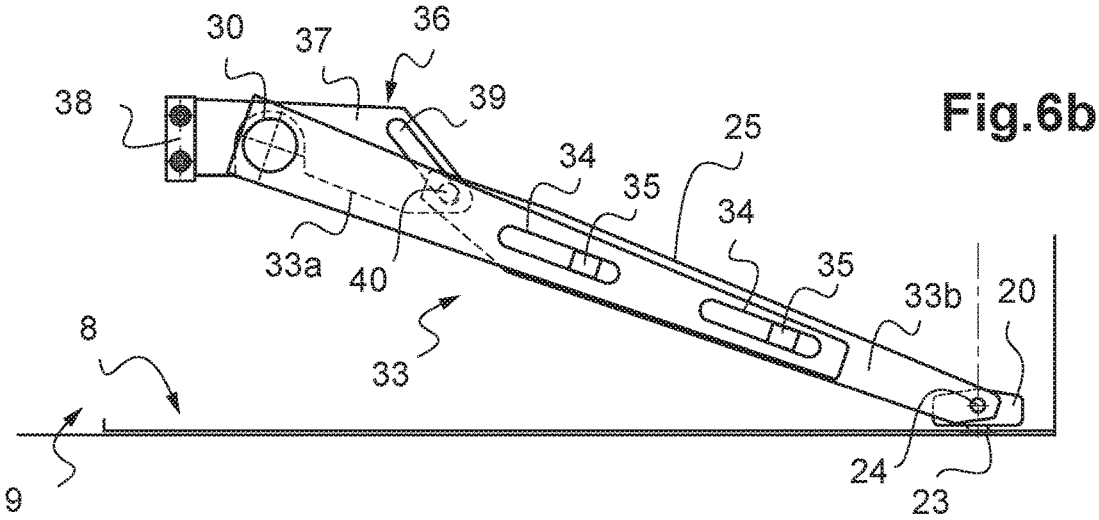
FIG. 6*b* is a view similar to FIG. 6*a* with the grasping device in the lower position.

According to another example visible in FIGS. 6*a*, 6*b*, the control element 36 comprises an inclined slot 39, which is particularly simple to realize to obtain the vertical movement of the suction element 20. The slot 39 extends along a straight line forming an angle of, for example, between 25° and 55° with the vertical.

According to one embodiment, the inclined slot 39 is formed in a plate 37 fixed to the transverse beam 38 of the support 21. The inclined slot 39 cooperates with a protuberance 40 borne by the end of the distal arm 33*b*.

Figure 7:
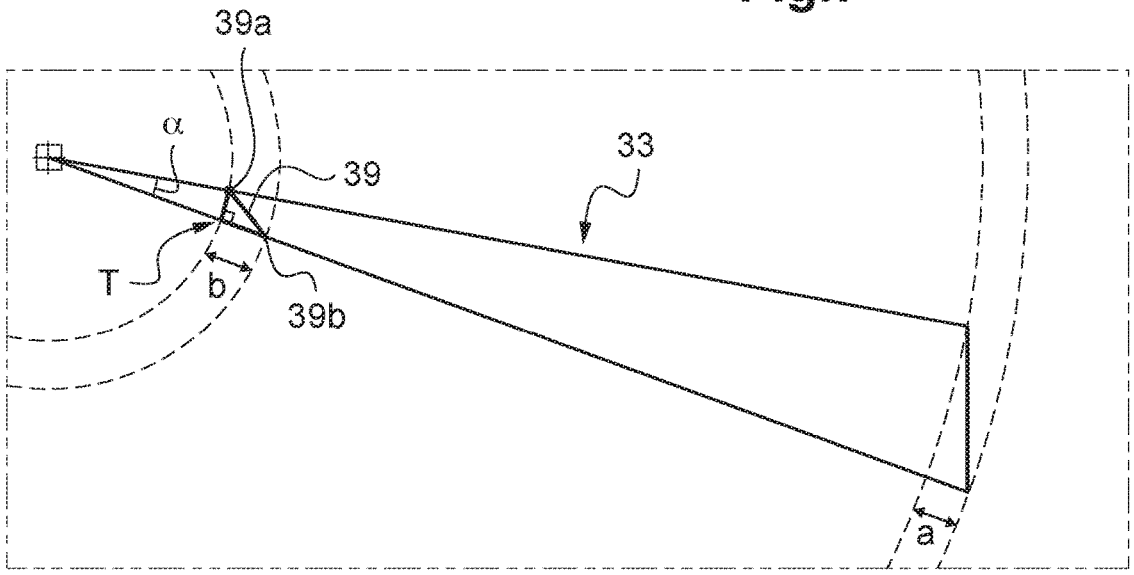
FIG. 7 is a schematic view illustrating the geometric relations between the pivoting angle of the telescopic arm, the lengthening of the telescopic arm, and the orientation and the dimension of a slot of an element for controlling the lengthening of the distal arm of the grasping device of FIG. 2.

More precisely, and as schematically illustrated in FIG. 7, the positioning of the distal arm 33*b* in a first position 39*a* of the slot 39 corresponds to a minimum lengthening of the telescopic arm 33 in the upper position. The positioning of the distal arm 33*b* in a second position 39*b* of the slot 39 corresponds to a maximum lengthening of the telescopic arm 33 in the lower position after the telescopic arm 33 has pivoted by a predetermined maximum angle $\alpha$ between the first and the second positions. The hypotenuse of a right triangle T of which one of the legs, the longer one b, corresponds to the lengthening a of the telescopic arm 33 over the predetermined maximum angle $\alpha$ is inscribed within the slot 39.

Each proximal arm 33*a* is, for example, formed by a double wall sandwiching a distal arm 33*b*, for example by covering the distal arm 33*b* approximately over two thirds thereof in the upper position (FIG. 6*a*). Oblong holes 34 are formed in each wall of the double wall in parallel and cooperate with pins 35 arranged on either side of the distal arm 33*b*. The plates 37 of the elements 36 for controlling the telescopic arms 33 are, for example, interposed between the walls of the double wall of the proximal arms 33*a* upstream of the distal arms 33*b*.

The grasping device 13 can comprise at least one actuator 41, such as a jack, for example a pneumatic jack, configured to pivot the pivoting axle 30 (FIG. 5). The actuator 41 is, for example, configured to stop automatically under the effect of a counterforce. Thus, when the suction element 20 bears against the insert sheet stack 8, the counterforce exerted by the stack 8 is detected by the actuator 41, which stops the rotation. The travel of the actuator 41 can thus be modulated as a function of the height of the stack 8 of insert sheets.

The grasping device can comprise a lever 42, with the actuator 41 connected to a first end of the lever 42. A second end of the lever is fixed to the pivoting axle 30. The lever 42 is, for example, connected to an end of the pivoting axle 30 that is situated on the outer side of the lateral cheek 32 on which the actuator 41 can be fixed. The actuation of the jack causes the lever 42 to pivot, causing the pivoting axle 30 to rotate and consequently the distal arms 33*b* to lengthen or shorten.

The pivoting axle 30 pivots, for example, in bearings 31 fixed to the lateral cheeks 32 of the support 21. It can also be envisioned that the grasping device 13 comprises a first and a second pivoting axle aligned transversely and cooperating with a respective bearing 31 fixed to a respective lateral cheek 32 (not shown). In the latter case, provision is made, for example, for the grasping device 13 to comprise two actuators 41 configured to drive a respective pivoting axle.

The operation of the grasping device 13 will now be described with reference to FIGS. 2, 3, 6*a* and 6*b*, considering the starting position to be the extended position of the non-stop receiving grid 12 in the receiving region 2 away from the tray 11 (FIG. 2). The suction element 20 is in the upper position (FIG. 6*a*).

Rotating the pivoting axle 30 (in the clockwise direction of rotation in FIGS. 6*a*, 6*b*) translationally moves the pins 35 of the distal arms 33*b* in the oblong holes 34 of the proximal arms 33*a* and translationally moves the protuberance in the inclined slot 39 of the control element 36, lengthening the telescopic arms 33. This combination of rotation-lengthening of the telescopic arms 33 moves the suction element 20 vertically toward the stack 8 of insert sheets in the housing 9 of the tray 11 into the lower position (FIG. 6*b*).

The suction element 20 is then in contact with the edge of the insert sheet at the height where the sheet is situated in the housing 9. The grasping region can thus always be provided at the same location of the insert sheet independently of the height of the stack 8 of insert sheets. The suction force of the suction element 20 and/or gravity correctly positions the suction element 20 in order to grasp an insert sheet flat. The actuator 41 automatically stops the pivoting of the pivoting axle 30 under the effect of this counterforce.

Once the insert sheet has been grasped, the actuator 41 is controlled by the control unit 7 to drive the pivoting axle 30 in the opposite direction. The effect of this is to shorten the telescopic arms 33 and to lift the insert sheet into the upper position by a vertical movement of the suction element (FIG. 6*a*).

Figure 3:
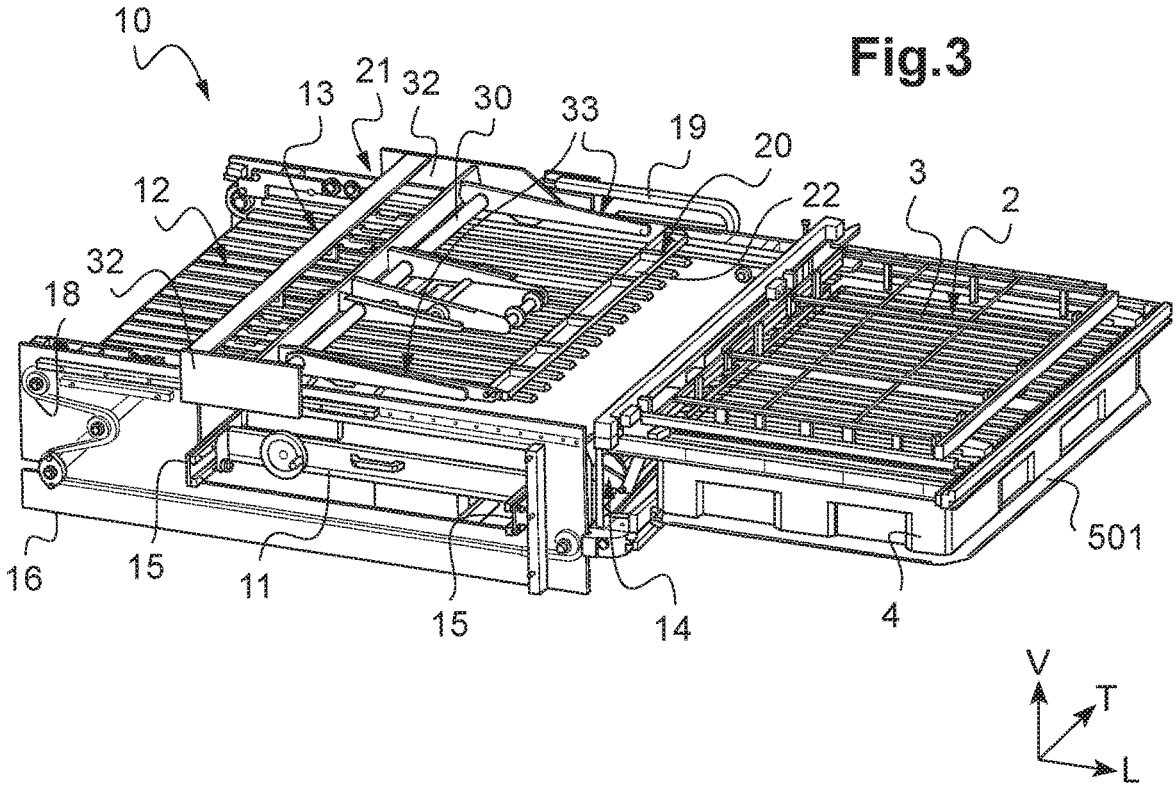
FIG. 3 is a view similar to FIG. 2 with the non-stop receiving grid situated above a reserve tray for insert sheets.
Figure 4:
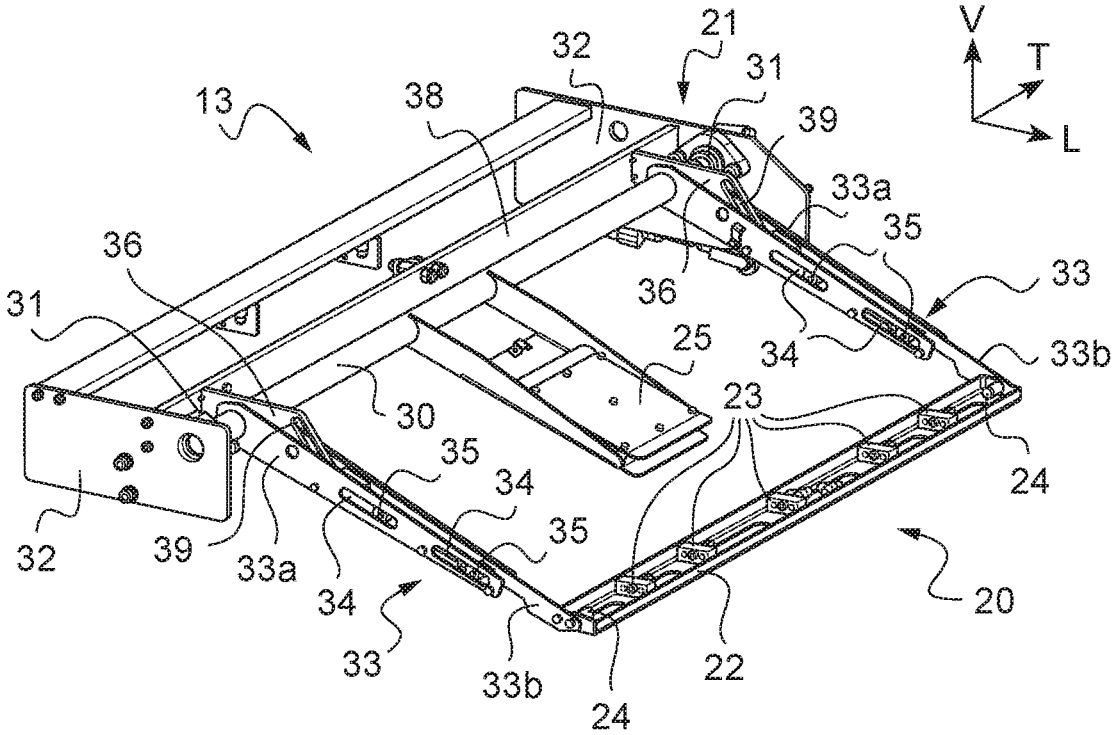
FIG. 4 shows a perspective view of the grasping device of FIG. 2 in the lower position.

The insert sheet can then be released onto the non-stop receiving grid 12 for blanks on its return from the receiving region 2 into the retracted position (FIG. 3).

Since the receiving region is always provided at the same location of the insert sheet, it is ensured that the insert sheet is correctly positioned on the non-stop receiving grid 12.

This device 13 for grasping insert sheets therefore takes up little space, even in the upper position, thereby making it possible to arrange the grasping device 13 below the removal belt of the machine 1. The grasping device 13 additionally makes it possible for the suction element 20 to be lowered sufficiently low into the housing 9 of the tray in order to be able to grasp an insert sheet at the bottom of the tray 11.

The non-stop receiving grid 12 carrying the insert sheet is then moved under the lower tool 3 for separating the blanks in order to deposit the insert sheet. The non-stop receiving grid 12 then returns above the stack of insert sheets to receive a new sheet. When leaving the receiving region 2, the non-stop receiving grid 12 crosses the teeth of the retaining comb 14 which has pivoted into the retaining position (FIG. 2) to retain the insert sheet and hence the blanks stacked on this insert sheet. The non-stop receiving grid 12 thus makes it possible to deposit an insert sheet between the stacks of blanks and can also make it possible to support the blanks during the removal of the receiving pallet 4 bearing the stacks of blanks and to insert a new empty receiving pallet 4 without stopping the production.

Figure 8:
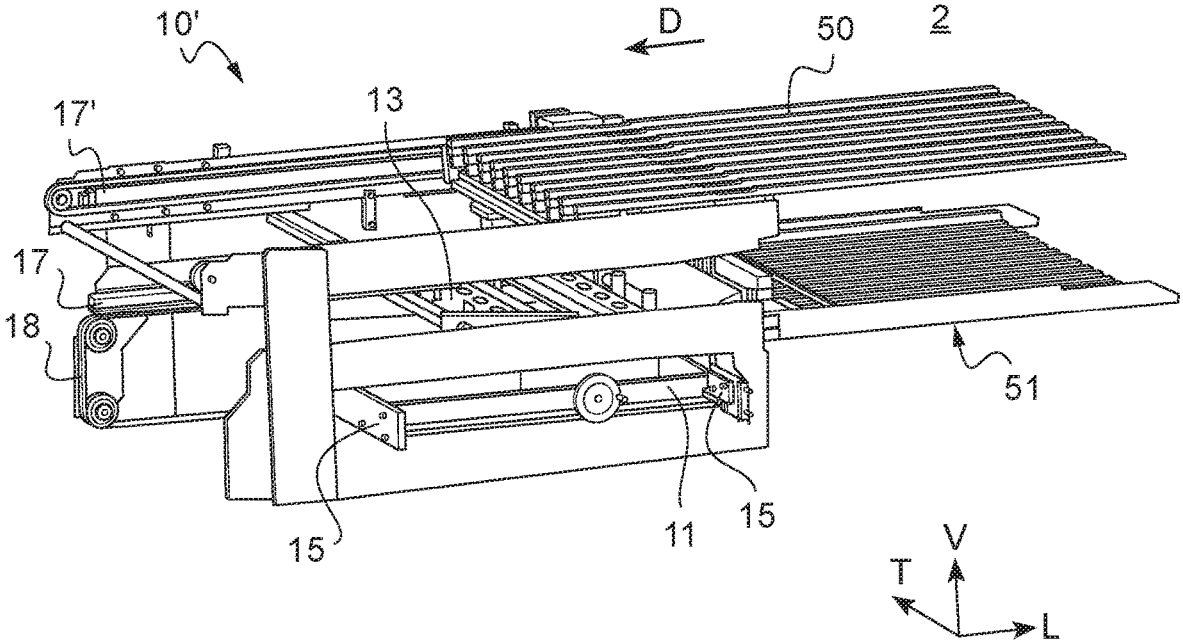
FIG. 8 shows a second exemplary embodiment of a device for loading insert sheets with a non-stop receiving grid and an inserter in the extended position.

As can be seen in the second example illustrated by FIG. 8, the invention is not limited to a device 10 for loading insert sheets that comprises a non-stop receiving grid 12 adapted to ensure the insertion operations but can also be applied to a loading device 10' provided, on the one hand, with a non-stop receiving grid 50 for blanks and, on the other hand, with a movable inserter 51.

The inserter 51 is movable between a retracted position for receiving an insert sheet and an extended position for depositing the insert sheet in the receiving region 2 between the stacks of blanks. The inserter 51 is driven translationally by two chains 18 driven by an actuator, such as a pneumatic linear jack (not visible), controlled by the control unit 7 of the processing machine 1 in order to program an insertion when the stack of blanks reaches the desired height.

However, in this embodiment, the support of the blanks during the removal of the stacks of blanks without stopping the production is provided by the separate non-stop receiving grid 50 for blanks that is situated above the inserter 51.

The non-stop receiving grid 50 for blanks comprises a plurality of longitudinal bars. It is movable in the longitudinal direction L between a retracted position in which it is situated above the grasping device 13 and an extended position in the receiving region 2 of the station 500 for receiving blanks in order to receive the blanks during the removal of the receiving pallet 4. The non-stop receiving grid 50 for blanks is also movable vertically by a motorized drive in order to adapt to the level of accumulation of the blanks. The non-stop receiving grid 50 for blanks of this embodiment does not provide the insertion function.

It should also be noted that the invention is not limited to a station 500 for receiving blanks in which the points of attachment between the blanks are separated, but can be applied to a station for receiving blanks that receives stacks of full sheets.

The invention claimed is:

1. A grasping device for grasping insert sheets for a loading device for loading insert sheets at a station for receiving blanks being moved in a blank feeding direction, the grasping device comprising:

a suction element configured to grasp an insert sheet;

a pivoting axle, and at least one telescopic arm configured to move insert sheets in a direction different from the blank feeding direction, the telescopic arm comprised of:

a proximal arm, one end of the proximal arm being fixed to the pivoting axle and configured to be pivoted so as to pivot the telescopic arm with respect to the pivoting axle, and a distal arm movable with respect to the proximal arm, one end of the distal arm is pivotally articulated with the suction element and configured to move the suction element between an upper position and a lower position by a vertical movement of the suction element, wherein the distal arm is configured to move with respect to the proximal arm so as to increase a length of the telescopic arm from a first length of the telescopic arm at a start of a pivoting swing of the telescopic arm at the upper position to a second length of the telescopic arm at a remote end of the pivoting swing of the telescopic arm at the lower position, the second length being greater than the first length.

2. A grasping device according to claim 1, wherein in the upper position thereof, the telescopic arm is in a position close to the horizontal.

3. A grasping device according to claim 1, further comprising at least one control element for controlling the lengthening of the distal arm as a function of a pivoting angle of the pivoting axle, the control element is configured to cooperate with the distal arm of the telescopic arm.

4. A grasping device according to claim 3, wherein the control element comprises a linear or curved guide.

5. A grasping device according to claim 3, wherein the control element comprises an inclined slot, wherein the positioning of the distal arm in a first position of the slot corresponds to a minimum lengthening of the telescopic arm in the upper position of the telescopic arm;

wherein the positioning of the distal arm in a second position of the slot corresponds to a maximum lengthening of the telescopic arm in the lower position thereof, the telescopic arm having pivoted by a predetermined maximum angle between the upper and the lower positions; and wherein the hypotenuse of a right triangle of which one of the legs of the triangle corresponds to the lengthening of the telescopic arm over the predetermined maximum angle is inscribed within the inclined slot.

6. A grasping device according to claim 1, wherein one of the distal arm and the proximal arm comprises at least one oblong linear guide hole which is configured to cooperate with at least one pin borne by the other arm in order to modify the length of the telescopic arm.

7. A grasping device according to claim 1, wherein the proximal arm comprises a double wall sandwiching the distal arm between the double walls.

8. A grasping device according to claim 1, wherein the suction element comprises at least one pivoting suction head.

9. A grasping device according to claim 1, wherein the suction element comprises a suction bar.

10. A grasping device according to claim 9, further comprising two of the telescopic arms having respective ends which are pivotally articulated with a respective end of the suction bar.

11. A grasping device according to claim 1, further comprising at least one actuator configured to pivot the pivoting axle.

12. A grasping device according to claim 11, wherein the at least one actuator is configured to stop automatically under the effect of a counterforce.

13. A grasping device according to claim 11, wherein the actuator is configured to move a first end of a lever, the lever having a second end fixed to the pivoting axle.

14. A device for loading insert sheets, comprising a device for grasping insert sheets according to claim 1.

15. A station for receiving blanks of a machine for processing blanks, the station comprising the loading device for loading the insert sheets according to claim 14.

16. A machine for processing blanks, comprising the station for receiving the blanks according to claim 15.

17. A station for receiving blanks according to claim 16, wherein the grasping device is configured to deliver insert sheets to the stack of blanks for separating the blanks in the stack.

* * * * *